US010362877B2

(12) United States Patent
Binfare et al.

(10) Patent No.: US 10,362,877 B2
(45) Date of Patent: Jul. 30, 2019

(54) CUSHION WITH SUPPORTING FRAME FOR UPHOLSTERED FURNITURE

(71) Applicant: EDRA S.P.A., Perignano di Lari (IT)

(72) Inventors: Francesco Binfare, Perignano di Lari (IT); Valerio Mazzei, Perignano di Lari (IT); Edoardo Mazzei, Perignano di Lari (IT)

(73) Assignee: EDRA S.P.A., Perignano di Lari (IT)

( * ) Notice: Subject to any disclaimer, the term of this patent is extended or adjusted under 35 U.S.C. 154(b) by 0 days.

(21) Appl. No.: 15/549,346

(22) PCT Filed: Feb. 10, 2016

(86) PCT No.: PCT/IB2016/050703

§ 371 (c)(1),
(2) Date: Aug. 7, 2017

(87) PCT Pub. No.: WO2016/128911

PCT Pub. Date: Aug. 18, 2016

(65) Prior Publication Data

US 2018/0020839 A1 Jan. 25, 2018

(30) Foreign Application Priority Data

Feb. 13, 2015 (IT) ..... PI2015A0006

(51) Int. Cl.
*A47G 9/10* (2006.01)
*A47C 20/04* (2006.01)
(Continued)

(52) U.S. Cl.
CPC ..... *A47C 17/12* (2013.01); *A47C 7/402* (2013.01); *A47C 7/42* (2013.01); *A47C 20/04* (2013.01)

(58) Field of Classification Search
CPC ..... A47C 17/12; A47C 7/402; A47C 7/42; A47C 7/54; A47C 20/04; A47G 9/10
See application file for complete search history.

(56) References Cited

U.S. PATENT DOCUMENTS 7,758,119 B1 * 7/2010 Baterdouk ..... A47C 7/72 297/217.6
9,095,231 B2 * 8/2015 Abdo ..... A47G 9/1009
(Continued)

FOREIGN PATENT DOCUMENTS

DE 202008012133 1/2009
DE 202009006801 8/2009
(Continued)

OTHER PUBLICATIONS

International Search Report for PCT/MY2015/050125 dated May 13, 2016.
(Continued)

*Primary Examiner* — Robert G Santos
*Assistant Examiner* — Rahib T Zaman
(74) *Attorney, Agent, or Firm* — Preston Smirman; Smirman IP Law, PLLC

(57) ABSTRACT

A cushion (1) whose configuration can be varied is constituted by a cushion element (10) inside which there is a fixed frame (20), which covers a lower section (13) of said cushion element (10), and two movable frames (25A), (25B), symmetrical, hinged above said fixed frame (20) and adapted to be comprised within an upper section (14) of the cushion element (10) itself. The movable frames (25 A), (25B) can swing up to 180° independently of one another, for aligning a respective portion (14A), (14B) of said upper section (14) from an external horizontal position (HE) to an internal horizontal position (HI), passing through a vertical neutral position (N) in which the same portion (14A), (14B) is substantially aligned with said lower section (13). In a sofa (D) or an armchair (P) in which the backrest (100) and the armrests (110) are defined by respective cushions (1), many possible configurations of the same are possible, in order to offer maximum seating comfort.

12 Claims, 3 Drawing Sheets

(51) Int. Cl.

| | |
|---|---|
| ***A47C 7/42*** | (2006.01) |
| ***A47C 7/54*** | (2006.01) |
| ***A47C 17/12*** | (2006.01) |
| ***A47C 7/40*** | (2006.01) |

(56) References Cited

U.S. PATENT DOCUMENTS

| | | | | |
|---|---|---|---|---|
| 2013/0014327 | A1* | 1/2013 | Downey | A47C 20/027 5/632 |
| 2016/0037932 | A1* | 2/2016 | Binfare | A47C 7/38 297/117 |
| 2017/0135506 | A1* | 5/2017 | Holmes | A47D 13/083 |

FOREIGN PATENT DOCUMENTS

| | | |
|---|---|---|
| DE | 202011001464 | 4/2011 |
| EP | 0405681 | 1/1991 |
| FR | 2736250 | 1/1997 |
| WO | 2014162292 | 10/2014 |

OTHER PUBLICATIONS

Written Opinion of the International Searching Authority for PCT/MY2015/050125 dated May 13, 2016.
International Preliminary Report on Patentability for PCT/MY2015/050125 dated Aug. 15, 2017.
Machine Translation of DE202009006801.
English Abstract of EP0405681.
English Abstract of FR2736250.
Machine Translation of DE202008012133.
Machine Translation of DE202011001464.

* cited by examiner

CUSHION WITH SUPPORTING FRAME FOR UPHOLSTERED FURNITURE

CROSS-REFERENCE TO RELATED APPLICATION

The instant application is a national phase of PCT International Application No. PCT/IB2016/050703, filed Feb. 10, 2016, and claims priority to Italian Patent Application Serial No. PI2015A000006, filed Feb. 13, 2015, the entire specifications of both of which are expressly incorporated herein by reference.

TECHNICAL FIELD

The present invention concerns a cushion provided with a supporting structure for upholstered furniture, in particular beds, sofas or armchairs.

BACKGROUND ART

In the field of upholstered furniture for leaning or seating such as beds, sofas and armchairs, a special attention is paid to the comfort of use.

From the point of view of the position taken, to ensure that that position is the most ergonomic or the most appropriate for certain activities, they are conventionally known upholstered furniture with reclining backrests.

Upholstered backrests and armrests with adjustable position for sofas and armchairs of conventional type have a fixed lower portion and an upper portion that can assume a plurality of angular positions, in one direction or another, with respect to the lower portion. These conventional upholstered backrests or armrests comprise a flat fixed frame portion and a flat movable frame portion hinged to the fixed portion to allow rotation of the movable portion in a plane orthogonal to the plane of the frame. Both the fixed portion and the movable portion of the frame are contained within the same container element in flabby material, such as leather, fabric or the like, and between the frame and the container element are interposed cushioning elements in yielding material that confer a given volume to the backrest or armrest. Backrests, armrests or even upholstered headboards for beds of the type described above allow you to take on different postures when desired and the comfort they give suffers from several limitations. First, they are equipped with only one degree of freedom of rotation for which the number and the type of configurations that they can assume is limited. Furthermore, since they have to carry out a fundamental function of supporting the body weight they have internal frames and stiff cushioning which cannot guarantee the maximum comfort, so that very often stand-alone pillows are associated with them simply having the function of increasing the softness and pliability of the support surface. A solution of this type is given in the published patent application with n. DE 20 2009 006801 U1 in which is described a backrest for sofas that has a lower portion that comprises a fixed rigid frame and an upper portion that has a movable frame with a single degree of freedom of rotation with respect to the fixed frame. In addition, the backrest described provides means for connecting to the seat that are removable thanks to a pin that protrudes outwards from the lower end of the backrest and is connected in sliding mode to an internal frame of the seat.

The above limits are at least partially overcome by the armrests and backrests for sofas and armchairs described in the international patent application WO 2014/162292 A1, in the name of the same applicant, in which to a fixed lower frame are hinged at least two movable frames which can swing independently one from the other with respect to the fixed frame. A backrest or armrest as described in said international application has two or more degrees of freedom of rotation and can therefore assume a much greater number and type of configurations. Moreover, the space inside the backrest or armrest comprised between two independent movable frames does not present elements of rigid frame and it can be filled with upholstery with degree of filling also very low, thus realizing the smoothness and softness typical of the pillows. However, even this latter solution has limitations relatively to the versatility and comfort of use since the fixed portion of the backrest or armrest is rigidly fixed to the frame of the furniture so that it is not possible, except by adding free pillows, to adjust the softness of the support exactly where you want.

The pillows or cushions are furnishing substantially constituted by a container element in a flabby material such as leather, fabric, or other similar material, containing within cushioning materials up to a specific and desired degree of filling. There are pillows or cushions of the most varied shapes and size, and yet the most popular pillows, which for descriptive simplicity will be referred to below, are those who have two opposite sides of substantially identical rectangular shape and a relatively low thickness with respect to the area of the above sides. The pillows used for sitting or resting furniture such as beds, sofas, armchairs to make them more comfortable are cushions in which the degree of filling with the filling material is relatively low since their main task is to provide a particularly soft and pliable support for certain body portions. In fact, the main advantage deriving from the use of free cushions on sitting or resting furniture such as sofas, armchairs or beds is to provide an element softer and more comfortable than the simple support surfaces of the furniture itself and that at the meantime can be moved easily and freely in any position to give more softness when you most feel the need. However, conventional pillows can only be used to make it more soft and yielding the supporting surface but they do not substantially perform any supporting function, as they do not provide sufficient rigidity.

There are also cushions whose main function is to support certain body portions that are equipped with an internal frame and connecting members suitable to be inserted into an appropriate slot of a furniture to which can be associated. Cushions of this type are for example those used as headrest. However, conventional cushions-like headrests have a very limited softness and pliability as they must have mainly support function, and are fastened to the respective furniture in a substantially fixed position. A cushion of the aforementioned type, used as backrest for a sofa is for example described in the European patent application published with no. EP 0405681 A1 which describes a cushion for sofas that includes a lower portion in which is present a frame composed of rigid elements connected together so as to allow flexibility to rotations around a plurality of vertical axis and an upper portion in which there are a plurality of elongate flexible elements that allow significant overall flexibility of the upper portion. Two pins protrude downwardly from the rigid frame of the lower portion to be inserted in suitable holes of the seat so that the cushion can be associated with and removed from the corresponding seat. The cushion described above has a great flexibility and nevertheless presents some limits. First, the inner frame has a rather complex structure that entails high manufacturing costs. Furthermore, the cushion can be associated to the furniture only at its bottom side and the shape that the lower portion takes depends largely on the position of the housing holes provided in the seat.

SUMMARY OF THE INVENTION

The object of the present invention is therefore to provide a cushion that can be stably associated to an upholstered furniture for resting or sitting such as beds, sofas and armchairs, that has great versatility of use.

A further object of the invention is to propose a cushion that can be stably associated to upholstered furniture for sitting or resting such as beds, sofas and armchairs, which has excellent softness and pliability while maintaining adequate body support.

Another object of the invention is to offer a kind of cushion that can be stably associated to a upholstered furniture for sitting or resting such as beds, sofas and armchairs, equipped with means able to stabilize each preset configuration even in the absence of the body burden, while preserving an adequate pliability, in a manner that the same cushion can be modelled to the shape of the body, all without sensing the presence of internal rigid members.

A further object of the invention is to propose a upholstered furniture for sitting or resting such as a bed, sofa or armchair, comprising and to which can be associated stably in a plurality of different positions at least a cushion that provides both the support feature typical of a backrest and the features of comfort and versatility typical of free standing pillows.

The foregoing objects are fully achieved by a cushion for upholstered furniture for leaning or sitting such as beds, sofas or armchairs, in which are provided:

- cushion element, constituted by a upholstery of soft material stuffed in a flabby covering, configured so that they can be identified two main opposite sides separated by connecting portions with rounded and/or sharp edges that define a thickness of the cushion element;
- an elongated fixed frame extended in a horizontal direction inside the cushion element to define an upper section of the cushion element;
- at least two movable frames housed within the same cushion element at said upper section, with each of said movable frames being hinged, independently from the remainder, to the fixed frame according to at least a substantially horizontal hinge axis, so that each of said movable frames is able to take different positions, each of which is provided to determine a desired orientation of at least a portion of the upper section of the cushion element;
- movement control means associated with the hinge axes of the movable frames, suitable to determine the strain needed to swing the related mentioned movable frames respectively to allow the said orientation of the latter relative to said fixed frame and to stabilize each position reached,
- connecting members for connecting the cushion element with an external structure.

Advantageously, the connecting members are constituted by elongated rigid elements integral with the fixed frame and configured to extend not parallel to the cushion element main sides in such a way that it protrudes outwards said cushion element by passing through one or more passage holes aligned in the flabby covering and it extends of a determined amount from a rear side of said cushion element.

DESCRIPTION OF DRAWINGS

The characteristics of the invention will be easily understood from the following description of a preferred embodiment of the same, in accordance with the contents of claims and with the help of the attached pages of drawings, in which:

FIG. 1 illustrates a cushion according to the present invention in a first configuration in which the cushion connection members are arranged horizontally.

FIGS. 4 to 7 show variants of furniture according to the present invention comprising cushions according to the invention: FIGS. 4*b*, 5*b*, 6*b* and 7 show plan views.

DETAILED DESCRIPTION OF PREFERRED EMBODIMENTS

Figure 1A:
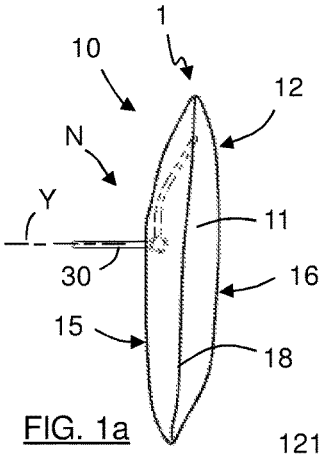
FIG. 1*a* shows a side view.

In the figures listed above it is indicated as a whole with the reference number 1 a cushion for upholstered furniture according to the present invention.

The cushion 1, as will be evident, is not so much suitable for a stand-alone use but rather to be associated with upholstered furniture such as beds, sofas or armchairs, in particular in correspondence of the armrests, backrests, or headboards.

The cushion 1 comprises a per se known cushion element, 10, constituted by a upholstery of soft material, 11, for example elastic polyurethane foam (foam rubber) having predetermined characteristics, inserted in a flabby covering, 12, for example fabric, synthetic or natural leather, and the like.

For simplicity of representation, in the figures the upholstery 11 is not shown. In a preferential way, the degree of filling of the flabby covering 12 is such that the cushion element 10 is as a whole very deformable and yieldable and elastic properties of the upholstery 11 are not such as to restore a preferential configuration in the absence of external strain, whereby the cushion element 10 assumes deformed configurations even in the presence of relatively small external stresses (such as for example a person's body weight) and tends to keep them in the absence of additional external stresses.

The cushion element 10 has two main sides: a front side, 16, and a rear side, 15, opposite to each other and perimetral joined by connection sides, 41, 42, 43, 44. In the embodiment depicted the main sides 15,16 are rectangular and the connection sides include seams, 18.

Inside the cushion element 10, immersed in the upholstery 11, it is housed an elongated fixed frame 20, for example a metallic tubular member, disposed to lie in a plane parallel to the main sides 15 and 16. In particular, in the rectangular shaped cushion element shown, the fixed frame extends horizontally parallel to two connection sides, 41, 42 and at an intermediate height of the remaining two connection sides, 43, 44, so as to identify in said cushion element 10 a lower section, 13, placed below the fixed frame 20 and an upper section, 14, above the fixed frame 20. Advantageously, the lower section 13 does not include elements of the frame and its conformation is therefore dictated solely by the deformability of the upholstery 11 and the flabby covering 12. Alternatively, the lower section 13 may comprise frame elements integral to the fixed frame (20), made of the same rigid material or flexible materials, such as plates of plastic or metallic material or the like.

Within the same cushion element 10, immersed in the upholstery 11, are housed, in addition, at least two movable frames 25A, 25B, for example symmetrically disposed, located at the upper section 14, with each of said movable frames 25A, 25B hinged, independently from the remainder, to the fixed frame 20, according to at least one hinge axis.

In the embodiment shown, each of said movable frames 25A, 25B is located in proximity of a relative connection side 43, 44 and is constituted by a tubular section that, following a three-dimensional trajectory form a substantially two-dimensional structure extending within a portion of the upper section 14 mainly towards the top connection side, 41. Each of said movable frames 25A, 25B is hinged according to a horizontal hinge axis X, coincident with the hinge axis of the remainder movable frame 25A, 25B, which in the embodiment shown corresponds to the longitudinal axis of the fixed frame 20. Each of the movable frames 25A, 25B identifies an upper section portion 14A, 14B that follows its swinging movements.

Each of said movable frames 25A, 25B can swing, independently of the other and preferably in a continuous mode (not in discrete steps) around its hinge axis X.

The cushion 1 of the invention also comprises connecting members, 30, constituted by elongated rigid elements integral with the fixed frame 20 and configured to extend not parallel to the main sides 15, 16 so as to protrude outwards the cushion element 10 by passing through one or more aligned passage holes provided in the flabby covering 12 and it extends of a determined amount from the rear side 15. In the embodiment shown, the connecting members 30 are constituted by a single straight bar element of constant circular cross-section which departs from a longitudinally intermediate section of the fixed frame and extends in a direction orthogonal to the rear side 15 from which it protrudes. The connecting members 30 protrude from the rear side 15 of the cushion element 10 at a passage aperture, 21, of the flabby covering 12 provided in correspondence of a central area of the rear side 15 itself, and the bar element is provided with a coupling portion with an external structure such as to allow its rotation around its axis (Y).

Figure 8:
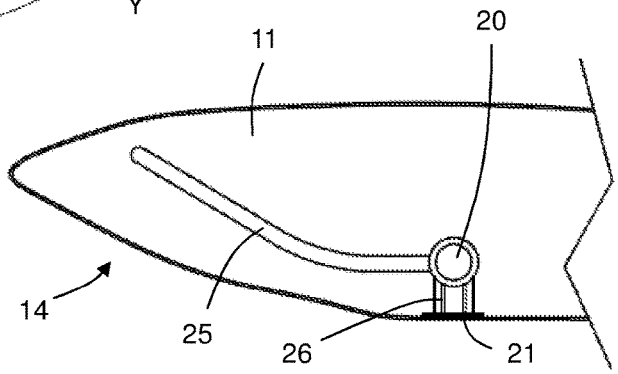
FIG. 8 shows, in a side view, a detail of the connection members arranged vertically, in accordance with one embodiment of the invention.
Figure 8:
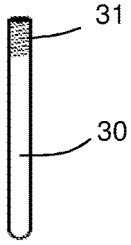

Advantageously, as shown in FIG. 8, the connecting members 30 are associated with the fixed frame 20 in a removable mode. The fixed frame 20 includes couplings members 26, integral with the fixed frame 20 for associating the connecting members 30 and arranged to be completely housed within the cushion element 10 but in communication with the passage aperture 21 of the flabby covering 12. The connecting members 30 comprise corresponding coupling members, 31. In the embodiment of FIG. 8 the coupling members 26 and 31 are threaded members. Obviously, other types of coupling members, in particular quick-coupling members, can be envisaged.

Moreover, the flabby covering 12 provides elongated openings, 22, 23 that can be kept closed by means of zippers, Velcro joints or the like, to allow the removal of the flabby covering 12, for example to allow its cleaning or replacement. The elongated openings 22, 23 are arranged in the rear side 15 in such a way as to affect the passage apertures 21 of the connecting members 30. In this way the elongated openings 22, 23 intended for removal of the flabby covering 12 remain hidden in the normal use of the pillow 1 during which the rear side 15 is normally not visible because in contact with a furniture where the cushion is associated, and also the elongated openings 22, 23 themselves determine the passage apertures 21 of the connecting members 30 without having to provide specific holes or openings in the flabby covering 12.

In alternate embodiments, the connecting members 30 are integral to the flabby covering 12 instead of, or in addition to, being integral to the fixed frame 20 and they are constituted by seams, buttons or slots for buttons, snap buttons, zippers, or other similar means of connection. Solutions of this kind allow to avoid openings in correspondence of the flabby covering 12 to pass through the rigid elongated elements of the depicted embodiment, so as to simplify and thereby reduce the costs of the connecting members 30 themselves as well as of the corresponding housing or connection means which must be provided in the upholstered furniture where the cushion 1 of the invention can be associated.

Figure 1B:
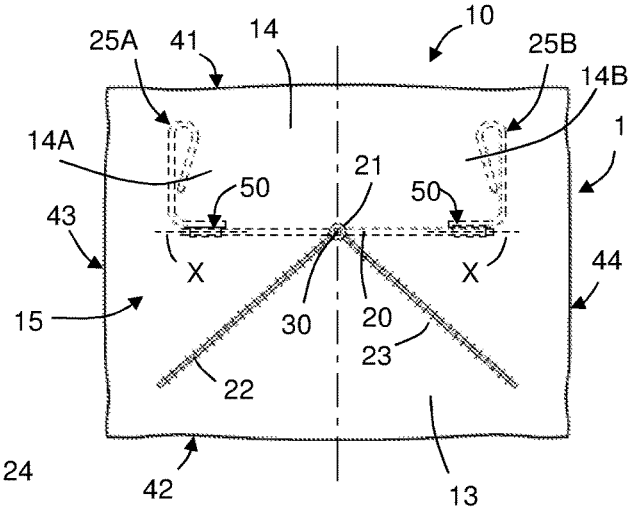
FIG. 1*b* shows a rear view.

In FIG. 1 the cushion 1 is represented in a neutral configuration, N, in which the connecting members 30 extend horizontally in a direction orthogonal to the fixed frame, also disposed horizontally, while the movable frame 25A and 25B extend upward, perpendicular to the connecting members 30. As can be observed in FIG. 1, in this configuration the cushion element 10 is in a unstressed or non-deformed configuration in which the lower section 13 extends downwards with respect to the fixed frame 20 subject to its own weight, while the upper section 14 extends upwards and is maintained in such position by the upward directed orientation of the movable frames 25A and 25B. A configuration like that of FIG. 1 may result from the association of the cushion 1 with an external structure having a suitably arranged housing means, for example a hole with a horizontal axis in a vertical wall.

Figure 3:
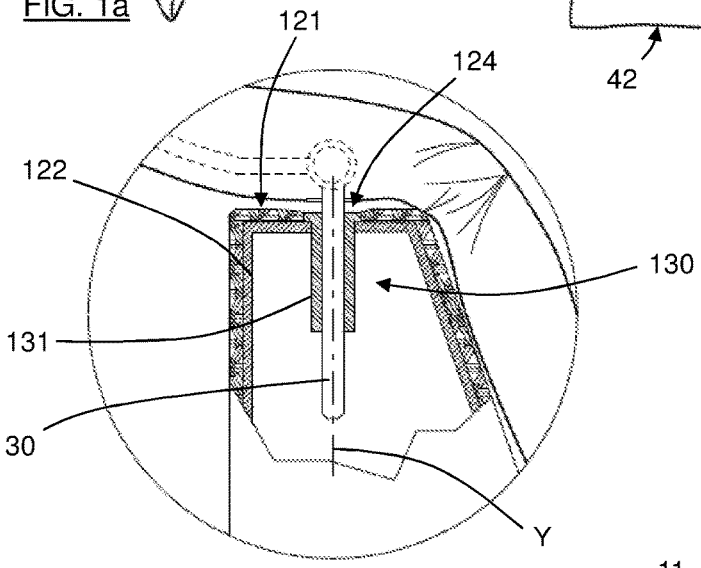
FIG. 3 shows a detail of FIG. 2*a;*

In FIGS. 2*a* to 2*d* the cushion of the invention is shown in a particularly advantageous embodiment in which it is associated with an upholstered furniture, 100, comprising at least a support plane, 110, substantially horizontal and at least one vertically extending wall, 120, extended upwards with respect to said support plane 110. The vertically extending wall 120 includes housing means, 130, for housing the connecting members 30 of the cushion 1 provided in correspondence with an upwards oriented surface, 121, of the vertically extending wall 120. The housing means 130 extend inside of the vertically extending wall 120 for receiving said connecting members 30 of the cushion as a result of a substantially vertical sliding movement from top to bottom of the latter. More specifically, with reference to the detail view of FIG. 3, the upward oriented surface 121 is the top surface of the armrest of a sofa. In the above upward oriented surface 121 there is an inlet opening, 124, in which a bushing, 131, oriented with vertical axis and made integral to a frame, 122, of the vertically extending wall 120, so that the connecting members 30 of the cushion 1 can be inserted in the housing means 130 so as to remain coupled rotatable with respect to their axis, Y, and sliding with respect to it.

Figure 2A:
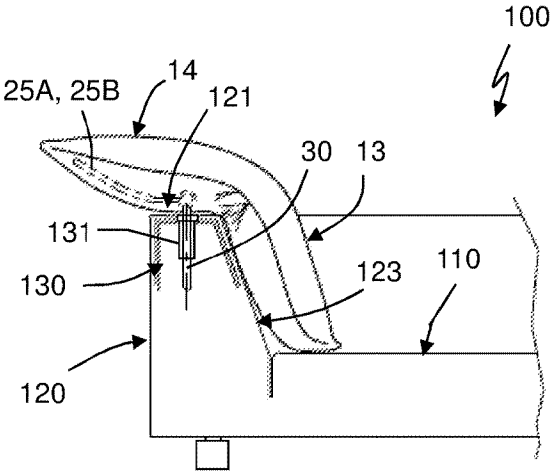
FIG. 2 shows in a front view, in partial section, a portion of an upholstered furniture according to the present invention comprising the cushion of FIG. 1 represented in four different configurations in FIGS. 2*a* to 2*d;*
Figure 2B:
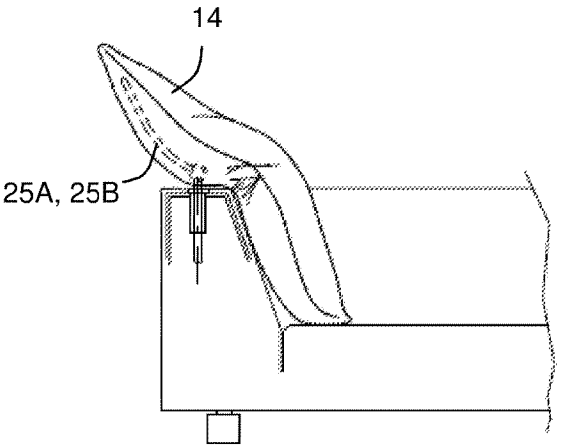
Figure 2C:
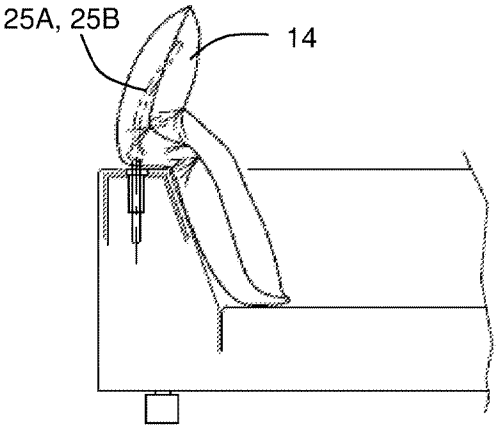
Figure 2D:
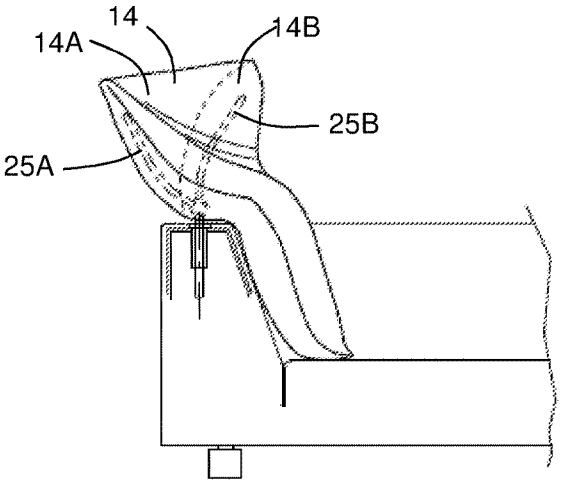
Figure 4A:
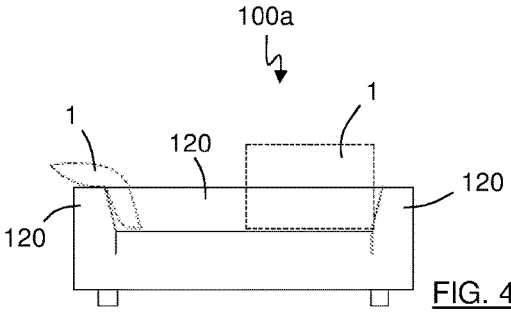
FIGS. 4*a*, 5*a* and 6*a* show front views.
Figure 4B:
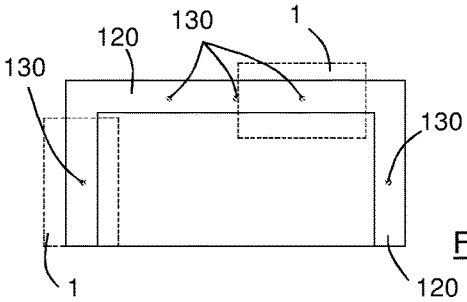
Figure 5A:
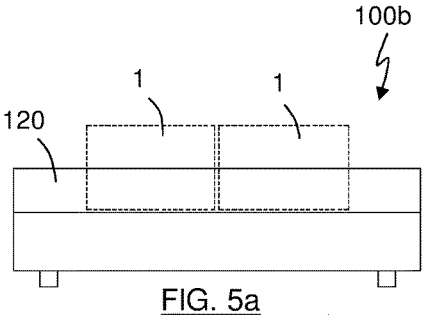
Figure 5B:
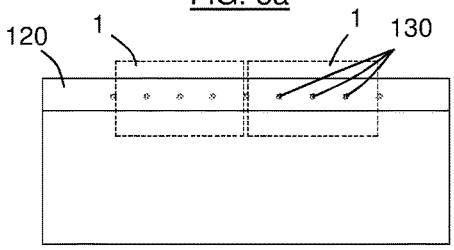
Figure 6A:
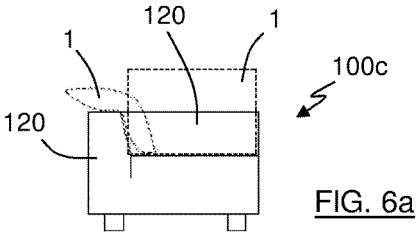
Figure 6B:
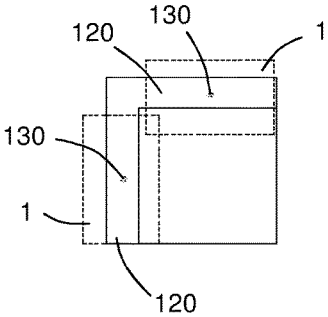

By way of example in FIGS. 2*a* to 2*d* are shown only four different configurations that the cushion 1, and then the sofa 100 to which it is associated, can assume. In FIG. 2*a* the relative orientation between the connecting members 30 and the movable frames 25A, 25B of the cushion 1 is the same as shown in FIG. 1 and yet, since the connecting members 30 are bound with the relative vertical Y axis the movable frames 25A, 25B extend in a substantially horizontal direction while maintaining substantially horizontal also the upper section 14 of the cushion 1. The lower section 13, not supported by an internal frame, subject to its own weight tends to recline on the inward directed surface 123, of the vertically extending wall 120. In this way, the lower section 13 of the cushion 1 acts as a soft upholstered coating of the inward directed surface 123 of the vertically extending wall 120 while the upper portion 14 constitutes an upholstered horizontal supporting plane. In FIGS. 2*b*, 2*c* and 2*d*, the position and thus the function of the lower section 13 does not change. In FIG. 2*b* the movable frames 25A, 25B are rotated upward at an angle of approximately 45° relative to an horizontal direction so that the upper section 14 is also inclined so as to provide a soft support plane angled of about 45° with respect to the horizontal direction. In FIG. 2*c* the movable frames 25A, 25B are rotated upward to extend in a substantially vertical direction so that the upper section 14 extends vertically to provide a soft support plane that may for example be a cervical support. In FIG. 2*d* the two movable frame 25A, 25B are oriented at different angles from each other with the movable frame 25A substantially oriented as in FIG. 2*b* and the movable frame 25B substantially oriented as in FIG. 2*c*, so that the top section 14 takes a twisted conformation in which the upper section portion 14A relative to the movable frame 25A is inclined at approximately 45° while the upper section portion 14B relative to the movable frame 25B is substantially vertical. The fact that the two movable frames 25A, 25B are spaced apart in the direction of the fixed frame extension 20, and the fact that the cushion's upholstery material has limited elastic properties and a rather low degree of filling, allow the cushion to take and maintain the twisted shape with a central portion of the upper section 14 which constitutes a connecting portion between the two upper section portions 14A, 14B relative to the movable frames 25A, 25B, respectively.

To the hinge axis X of the movable frames 25A, 25B, are associated respective movement control means 50, for example friction means, intended to restrain or permit the swinging movement of the movable frames 25A, 25B, calibrated so as to stably maintain each set position of the aforesaid movable frames 25A, 25B for stresses less than a certain predetermined amount.

In particular, the calibration of said movement control means 50 is such as to keep fixed in each set position said movable frames 25A, 25B at least when subjected to the action deriving from the weight of the body leaning on the said upper section 14, however without the need of an excessive effort for manually changing their orientation.

As can be imagined from the above description, a cushion according to the invention is particularly indicated in association with upholstered furniture, as it is adapted to define an upholstered support plane of an armrest or backrest, in the case of sofas or armchairs, or of a headboard in the case of bed. Indeed, in such applications the lower section 13 leans against a substantially vertical wall 120 constituting a soft element of support of the kidneys or, more generally, of the lower part of the torso, while the structure of the upper section 14 may be adapted to will be necessary for a soft support for the arm, or support for the shoulders and head with desired orientation. Moreover, thanks to the way it can be associated with the furniture 100, which provides a coupling with degrees of freedom of rotation and sliding with respect to the Y axis of the connecting members 30, the versatility of the cushion 1 and furniture 100 that includes it is still increased since the height of the cushion with respect to the backrest can be regulated and it can be adjusted also the angular orientation.

The versatility of upholstered furniture 100 according to the invention is even greater by providing a plurality of housing means 130 that can accept simultaneously a plurality of cushions according to the invention or which allow to move the same in multiple different areas of the upholstered furniture 100 itself.

Figure 7:
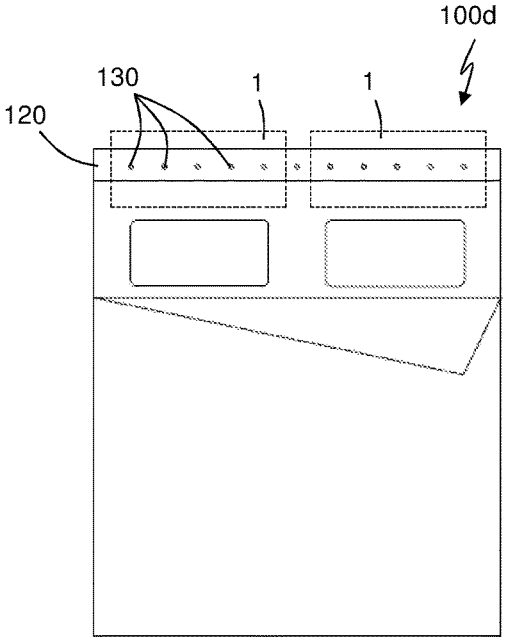

In the schematic FIGS. 4 to 7, are shown in a purely illustrative, and not limitative example, some upholstered furniture according to the invention. In FIGS. 4*a*, 4*b* is shown a sofa, 100*a*, which provides side walls and a rear wall. On the top of each of the side walls is a housing means, 130, while on the top of the rear wall are aligned, equidistant between them, three housing means 130. For each of the side walls it can be associated a cushion 1 with the prevailing function of armrest, while the rear wall can be associated with a cushion 1 as a function of backrests in one of three positions provided by housing means 130, or may be associated with two cushions leaving not used only the central housing means 130. In FIGS. 5*a*, 5*b* is shown a sofa, 100*b*, which only provides a rear wall 120 while it has no side wall. The rear wall 120 includes at its top a plurality of housing means 130 disposed aligned and equidistant, so that one or more cushions 1 can be housed in the positions defined by the housing means 130. In FIGS. 6*a*, 6*b* is shown an armchair, 100*c*, which provides a side wall 120 and a rear wall 120. Each of the two walls presents on its top a housing means 130 so that a cushion 1 can be inserted in each of them. Both the cushions 1 can indifferently be an armrest or backrest in dependence of the fact that the configuration of FIG. 2*a* is given to it, or the configuration of FIG. 2*c*, respectively. Both cushions could also be arranged symmetrically according to the FIG. 2*d* configuration to form a cervical support in the junction area of the two walls. In FIG. 7 is shown a bed, 100*d*, whose headboard 120 has at the top a plurality of housing means 130 aligned and equidistant, so that one or more cushions 1 can be housed in the positions defined by the housing means 130.

Obviously, a number of additional configurations are possible other than those described purely by way of example, allowed not only by the number of configurations which can take the cushion 1, but also by the number and layout of the housing means 130 as well as by the coupling means which provide degrees of freedom of sliding and rotation of the connecting means 30.

Furthermore, the features and the advantages highlighted above remain safe even in presence of modifications and variants to the cushion according to the invention as described above.

For example, the number and the shape of the movable frames 25A, 25B may vary. For example, in the case that the cushion is of greater longitudinal dimensions may be provided a further central movable frame in addition to two side movable frames 25A, 25B. Similarly, in the case of lower longitudinal size of the cushion or in the case that you want to give up part of flexibility of use of a cushion according to the invention, the cushion may comprise a single movable frame 25A or 25B arranged to affect the whole upper section 14 or only a portion 14A or 14B of it.

Furthermore, the fixed frame 20, in addition to having a more complex shape, may be located proximate to the lower side 42 of the cushion element 10, to the point that the lower section 13 may not be present.

In addition, it is important to point out that the connection means may be structured differently. For example, an embodiment provides two parallel bars as conventionally done in headrests. In this case, it gives up, to some extent, the versatility to increase stability. Still relatively to the connecting members 30, these could include engagement/release means suitable to allow a more stable coupling system with the housing means 130.

The cushion element 10 as a whole could have a shape also very different from the rectangular one shown, to adapt it to specific aesthetic or technical requirements of the furniture that the cushion must be associated.

These and further variants and modifications may be envisaged, and it is intended, however, that what described above is to be intended as not limiting example, therefore possible variants of detail that may be necessary for technical and/or functional reasons, are considered as of now included in the same protective scope defined by the annexed claims.

The invention claimed is:

1. A cushion for upholstered furniture for leaning or sitting such as beds, sofas or armchairs, including a cushion element, constituted by an upholstery of soft material stuffed in a flabby covering, the cushion element being configured so that two opposite main sides are defined that are peripherally joined by connection sides, comprising:

an elongated fixed frame arranged so as to define in the cushion element an upper section located above the fixed frame;

at least two movable frames housed within the same cushion element in correspondence of the upper section, with each of the movable frames being hinged, independently from the other, to the fixed frame according to at least one hinge axis substantially parallel to a direction of elongation of the fixed frame, and arranged to take different positions, each of which is provided to determine a desired orientation of at least one portion of the upper section of the cushion element;

movement control means associated with the hinge axes, adapted to determine an amount of deformation action needed to rotate the at least one movable frame, so as to maintain a stable position when a deformation action is applied that is lower than a certain predetermined amount; and connecting members for connecting the cushion element to an external structure;

wherein the fixed frame extends horizontally at a vertically intermediate level of the cushion element so as to define a lower section of the cushion element located below the fixed frame, the lower section being devoid of rigid frame elements.

2. The cushion according to claim 1, wherein the connecting members are constituted by elongate rigid elements associated to the fixed frame and configured to extend from the fixed frame in such a way that the connecting members protrude outwardly from the cushion element by passing through one or more passage holes provided in the flabby covering and the connecting members extend a determined amount from a rear side of the main sides of the cushion element.

3. The cushion according to claim 1, wherein the at least two movable frames extend to define corresponding profiled members rotatable about a common axis in a vicinity of opposite longitudinal ends of the fixed frame and extending mainly in a direction of an upper end of the upper section.

4. The cushion according to claim 1, further comprising coupling members, wherein the coupling members are operable to removably attach the connecting members to the fixed frame, wherein the coupling members are completely contained within the cushion element.

5. The cushion according to claim 2, wherein the connecting members comprise: a bar element that extends from the fixed frame from a longitudinally central portion therefrom; wherein, in order to extend outwards, the cushion element comprises an opening of the flabby covering provided at a vertically central area of the rear side; wherein the bar element is provided with a coupling portion adapted to allow rotation around a bar element longitudinal axis and connected to an external structure.

6. The cushion according to claim 2, wherein the flabby covering includes elongated openings closable by means of zippers or hook and loop fasteners, wherein, to permit removal of the flabby covering, the elongated openings are arranged in the rear side in such a way as to affect the passage holes for the connecting members.

7. The cushion according to claim 1, wherein the movement control means are of the friction type and calibrated so as to stably maintain each position set by the movable frames upon actions weaker than a predetermined entity.

8. Upholstered furniture including at least one upholstered support plane being substantially horizontal and at least one vertically extending wall extending upwards with respect to the support plane, comprising:

at least one cushion according to claim 1 and operably associated with the vertically extending wall by means of the connecting members.

9. The upholstered furniture according to claim 8, wherein the vertically extending wall provides means for housing or receiving the connecting members of the cushion, wherein the housing or receiving means are provided in correspondence to an upward oriented surface of the vertically extending wall.

10. The upholstered furniture according to claim 9, wherein the housing or receiving means comprise a bushing integral to a frame of the vertically extending wall and disposed in proximity to the upward oriented surface of the vertically extending wall in order to realize in it an opening, an internal bore of the bushing being suitable for accommodating the bar element of the cushion.

11. The upholstered furniture according to claim 9, wherein the vertically extending wall is an armrest or a backrest of a sofa or armchair, or a headboard of a bed, wherein the housing or receiving means are operably associated with a substantially horizontal top side of the vertically extending wall extending inwardly of the vertically extending wall for receiving the connecting members of the cushion as a result of a substantially vertical sliding of the same.

12. The upholstered furniture according to claim 9, further comprising a plurality of housing or receiving means arranged with a plurality of respective openings aligned along the upward oriented surface of the vertically extending wall.

* * * * *